US011035015B2

(12) United States Patent
Yoshida et al.

(10) Patent No.: US 11,035,015 B2
(45) Date of Patent: Jun. 15, 2021

(54) VAPOR FILM-RUPTURING AGENT, AND THERMAL TREATMENT OIL COMPOSITION

(71) Applicant: IDEMITSU KOSAN CO., LTD., Chiyoda-ku (JP)

(72) Inventors: Yukio Yoshida, Ichihara (JP); Hideaki Hattori, Funabashi (JP); Akinori Yomogita, Ichihara (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 243 days.

(21) Appl. No.: 15/544,180

(22) PCT Filed: Jan. 19, 2016

(86) PCT No.: PCT/JP2016/051459
§ 371 (c)(1),
(2) Date: Jul. 17, 2017

(87) PCT Pub. No.: WO2016/117566
PCT Pub. Date: Jul. 28, 2016

(65) Prior Publication Data

US 2018/0010203 A1 Jan. 11, 2018

(30) Foreign Application Priority Data

Jan. 21, 2015 (JP) ..... 2015-009561
Jan. 21, 2015 (JP) ..... JP2015-009559

(51) Int. Cl.

| | |
|---|---|
| ***C21D 1/58*** | (2006.01) |
| ***C10M 159/04*** | (2006.01) |
| *C10N 30/02* | (2006.01) |
| *C10N 40/20* | (2006.01) |
| *C10N 40/24* | (2006.01) |

(52) U.S. Cl.
CPC ..... *C21D 1/58* (2013.01); *C10M 159/04* (2013.01); *C10M 2203/1006* (2013.01); *C10N 2030/02* (2013.01); *C10N 2040/20* (2013.01); *C10N 2040/24* (2013.01)

(58) Field of Classification Search
CPC ..... C21D 1/58; C10M 159/04
USPC ..... 148/29
See application file for complete search history.

(56) References Cited

U.S. PATENT DOCUMENTS

| | | | |
|---|---|---|---|
| 3,681,150 A | 8/1972 | Brewster et al. | |
| 7,851,422 B2 | 12/2010 | Ichitani et al. | |
| 2007/0191241 A1* | 8/2007 | Ichitani | C10M 171/02 508/591 |
| 2015/0013843 A1 | 1/2015 | Noguchi et al. | |

FOREIGN PATENT DOCUMENTS

| | | | |
|---|---|---|---|
| CN | 1053443 | A | 7/1991 |
| CN | 1066293 | A | 11/1992 |
| CN | 1930309 | A | 3/2007 |
| CN | 101484560 | A | 7/2009 |
| CN | 103289741 | A | 9/2013 |
| CN | 104245968 | A | 12/2014 |
| JP | 10-158677 | A | 6/1998 |
| JP | 2007-9238 | A | 1/2007 |
| JP | 2008-69320 | A | 3/2008 |
| JP | 2008-69321 | A | 3/2008 |
| JP | 2010-229479 | A | 10/2010 |
| WO | WO 2005/087955 | A1 | 9/2005 |
| WO | WO 2013/137376 | A1 | 9/2013 |

OTHER PUBLICATIONS

Office Action dated Jan. 8, 2019 in Japanese Patent Application No. 2015-009559 (with English translation).
Office Action dated Jan. 8, 2019 in Japanese Patent Application No. 2015-009561 (with English translation).
Taiwanese Office Action dated May 15, 2019 in Taiwanese Patent Application No. 10820457630, 3 pages.
Combined Office Action and Search Report dated Jun. 1, 2018 in Chinese Patent Application No. 201680006211.3, (with English translation), 16 pages.
Huimin, C. "Handbook of Petroleum Asphalt Products", Petroleum Industry Press, Jul. 31, 2001, 1 page.
Xiaodong, T. "Function Principle and Application of Petroleum Processing Aids", Petroleum Industry Press, Nov. 30, 2004, 1 page.
"A Collection of Information on Heat Treatment", Department of Petrochemical Industry, Machinery Manufacturing Unit, Aug. 31, 1976, 5 pages.
Combined Chinese Office Action and Search Report dated Apr. 11, 2019 in corresponding Chinese Patent Application No. 201680006211.3 (with English Translation of Category of Cited Documents), 7 pages.

(Continued)

*Primary Examiner* — Weiping Zhu
(74) *Attorney, Agent, or Firm* — Oblon, McClelland, Maier & Neustadt, L.L.P.

(57) ABSTRACT

A vapor film-rupturing agent is provided that is prepared from asphalt as a staring material, so as to have a fraction (x) (% by mass) of a saturated component and a fraction (y) (% by mass) of an asphaltene component based on the total fraction 100% by mass of the saturated component, the asphaltene component, an aromatic component, and a resin component obtained by any one of analysis methods described in the Japan Petroleum Institute Standard and Manuals Testing Method for Petroleum Products JPI-5S-70-10 and the British Standard Test Method IP-469 that satisfy one or more of the following conditions (1) to (3): condition (1): $1.2926\times(x)/100-8.113\times(y)/100+2.3384\leq 2.400$, condition (2): $(y)\geq 7.0$, and condition (3): $((y)/(x))\geq 0.5$. The vapor film-rupturing agent is capable of preparing a thermal treatment oil composition having a high vapor film-rupturing effect with a characteristic number of seconds in the cooling capability test according to JIS K2242 (2012) of 2.50 seconds or less.

19 Claims, No Drawings

(56) References Cited

OTHER PUBLICATIONS

International Search Report dated Apr. 26, 2016 in PCT/JP2016/051459 filed Jan. 19, 2016.
Office Acton dated Mar. 26, 2021, in Indian Patent Application No. 201747025443 (with English-language Translation).

* cited by examiner

VAPOR FILM-RUPTURING AGENT, AND THERMAL TREATMENT OIL COMPOSITION

TECHNICAL FIELD

The present invention relates to a vapor film-rupturing agent, and a thermal treatment oil composition containing the vapor film-rupturing agent and a base oil.

BACKGROUND ART

A thermal treatment, such as quenching, of a metal material is generally performed for imparting desired hardness to the metal material with a thermal treatment liquid. Therefore, the thermal treatment liquid necessarily has an excellent cooling capability capable of enhancing the hardness of the metal material.

A liquid that is considerably excellent in cooling capability is water, but an aqueous thermal treatment liquid has a risk of hardening cracks formed in the metal material, and forms a large quenching distortion, due to the too high cooling capability thereof.

Accordingly, in a thermal treatment, such as quenching, of a metal material, an oil-based thermal treatment liquid, i.e., a thermal treatment oil, is generally used. PTLs 1 to 3 describe the thermal treatment oils.

Quenching of a metal material will be described. When a heated metal material is placed in a thermal treatment oil, the cooling rate thereof is not constant, and the material is cooled through the following three stages (1) to (3).

(1) The first stage where the metal material is enclosed with a vapor of the thermal treatment liquid (vapor film stage).

(2) The second stage where the vapor film is ruptured, and boiling occurs (boiling stage).

(3) The third stage where the temperature of the metal material becomes the boiling point of the thermal treatment liquid or lower, and the heat is removed through the convection (convection stage).

In the aforementioned three stages, the cooling rate becomes the fastest in the boiling stage as the second stage. In a general thermal treatment oil, the heat transfer coefficient showing the cooling capability quickly upraises particularly in the boiling stage, so as to form a considerably high temperature difference in the state where the vapor film stage and the boiling stage are mixed on the surface of the material to be treated, and due to the difference of the thermal contraction and the time difference of the transformation associated with the temperature difference, a thermal stress and a transformation stress occur to increase the quenching distortion.

Accordingly, when the period of time until the vapor film stage as the first stage is completed (i.e., the characteristic number of seconds in the cooling capability test according to JIS K2242 (2012), which may be hereinafter referred simply to as a "characteristic number of seconds") is longer, a quenching distortion tends to occur.

For avoiding the problem, a vapor film-rupturing agent is generally blended in a base oil as the thermal treatment oil, so as to shorten the vapor film stage.

For example, PTLs 1 to 3 describe that a polymer, such as a polyolefin, and asphalt may be blended as a vapor film-rupturing agent.

CITATION LIST

Patent Literatures

PTL 1: JP 2007-009238 A
PTL 2: JP 2008-069321 A
PTL 3: JP 2010-229479 A

SUMMARY OF INVENTION

Technical Problem

Thermal treatment oils are classified into Classes 1 to 3 in JIS K2242 (2012), and for example, those used for quenching include No. 1 oil and No. 2 oil of Class 1 and No. 1 oil and No. 2 oil of Class 2. These are classified by the "characteristic number of seconds in the cooling capability test according to JIS K2242 (2012)" showing the period of time until the vapor film stage as the first stage is completed.

With the shorter characteristic number of seconds, the vapor film-rupturing effect is higher, and a quenching distortion hardly occurs.

Accordingly such a vapor film-rupturing agent is demanded that is capable of providing a thermal treatment oil having a short characteristic number of seconds and having a high vapor film-rupturing effect.

An object of the present invention is to provide a vapor film rupturing agent capable of preparing a thermal treatment oil composition having a high vapor film-rupturing effect with a characteristic number of seconds in the cooling capability test according to JIS K2242 (2012) of 2.50 seconds or less, and a thermal treatment oil composition containing the vapor film-rupturing agent and a base oil.

Solution to Problem

The present inventors have found that the problem can be solved by adjusting a fraction of an asphaltene component in a vapor film-rupturing agent prepared from asphalt to a suitable range, and have completed the present invention described below.

According to one embodiment of the present invention, the following items [1] and [2] are provided.

[1] A vapor film-rupturing agent that is prepared from asphalt as a staring material, so as to have a fraction (x) (% by mass) of a saturated component and a fraction (y) (% by mass) of an asphaltene component based on the total fraction 100% by mass of the saturated component, the asphaltene component, an aromatic component, and a resin component obtained by any one of analysis methods described in the Japan Petroleum Institute Standard and Manuals Testing Method for Petroleum Products JPI-5S-70-10 and the British Standard Test Method IP-469 that satisfy one or more of the following conditions (1) to (3):

condition (1): a value T calculated from the following calculation expression (I) is 2.4000 or less, wherein x (% by mass) represents the fraction (x) of the saturated component, and y (% by mass) represents the fraction (y) of the asphaltene component:

$$T=1.2926\times x/100-8.113\times y/100+2.3384; \quad \text{Calculation expression (I):}$$

condition (2): the fraction (y) of the asphaltene component is 7.0% by mass or more; and condition (3): a ratio ((y)/(x)) of the fraction (y) of the asphaltene component and the fraction (x) of the saturated component is 0.5 or more.

[2] A thermal treatment oil composition containing the vapor film-rupturing agent according to the item [1] and a base oil.

Advantageous Effects of Invention

The vapor film-rupturing agent of the present invention is capable of preparing a thermal treatment oil composition having a high vapor film-rupturing effect with a characteristic number of seconds in the cooling capability test according to JIS K2242 (2012) of 2.50 seconds or less.

DESCRIPTION OF EMBODIMENTS

In the description herein, the "saturated component", the "asphaltene component", the "aromatic component", and the "resin component" are as described in the Japan Petroleum Institute Standard and Manuals Testing Method for Petroleum Products JPI-55-70-10 or the British Standard Test Method IP-469 as an analysis method employed for calculating the fractions of these components.

[Vapor Film-Rupturing Agent]

The vapor film-rupturing agent of the present invention is prepared from asphalt as a starting material, and may contain asphalt or may contain a residual oil derived from asphalt remaining after a separation process, such as distillation and refining, of asphalt.

The "asphalt" in the present invention means a semi-solid or solid substance mainly containing bitumen (i.e., a hydrocarbon compound soluble in carbon disulfide) as a natural substance or a crude oil residue, and specific examples thereof include straight asphalt and modified asphalt.

Examples of the straight asphalt include petroleum asphalt containing, as a major material, hydrocarbons having a boiling point of 550° C. or more recovered as a residual component in distillation under a reduced pressure of from 30 to 100 mmHg of an atmospheric residual oil having a boiling point of 350° C. obtained by distillation of a crude oil.

Examples of the modified asphalt include asphalt obtained by modifying the properties of the straight asphalt, such as solvent-deasphalted asphalt obtained through a solvent extraction treatment of the straight asphalt and blown asphalt obtained through an air oxidation treatment thereof.

There are cases where a polymer, such as a polyolefin, is used as a vapor film-rupturing agent, but a thermal treatment oil composition containing the polymer has a tendency that the polymer is broken to lower the vapor film-rupturing effect during the continuous use thereof. That is, a thermal treatment oil composition containing a polymer as a vapor film-rupturing agent has a problem in durability.

On the other hand, a vapor film-rupturing agent prepared from asphalt as a starting material can easily retain the vapor film-rupturing effect of a thermal treatment oil composition in long-term use, and thus has good durability.

As a result of investigations made by the present inventors on further enhancement of the vapor film-rupturing effect of the thermal treatment oil composition containing the vapor film-rupturing agent prepared from asphalt as a starting material, it has been found that the fraction of the asphaltene component in the vapor film-rupturing agent influences the vapor film-rupturing effect of the thermal treatment oil composition, and the present invention has been completed based on the knowledge.

The vapor film-rupturing agent of the present invention is prepared from asphalt as a staring material, so as to have a fraction (x) (% by mass) of a saturated component and a fraction (y) (% by mass) of an asphaltene component based on the total fraction 100% by mass of the saturated component, the asphaltene component, an aromatic component, and a resin component obtained by any one of analysis methods described in the Japan Petroleum Institute Standard and Manuals Testing Method for Petroleum Products JPI-5S-70-10 and the British Standard Test Method IP-469 that satisfy one or more of the following conditions (1) to (3):

condition (1): a value T calculated from the following calculation expression (I) is 2.4000 or less, wherein x (% by mass) represents the fraction (x) of the saturated component, and y (% by mass) represents the fraction (y) of the asphaltene component:

$$T=1.2926\times x/100-8.113\times y/100+2.3384;\quad \text{Calculation expression (I):}$$

condition (2): the fraction (y) of the asphaltene component is 7.0% by mass or more, and condition (3): a ratio ((y)/(x)) of the fraction (y) of the asphaltene component and the fraction (x) of the saturated component is 0.5 or more.

In the following description herein, the vapor film-rupturing agent that satisfies the condition (1) for the fraction (x) (% by mass) of the saturated component and the fraction (y) (% by mass) of the asphaltene component is referred to as the "vapor film-rupturing agent (1)", the vapor film-rupturing agent that satisfies the condition (2) therefor is referred to as the "vapor film-rupturing agent (2)", and the vapor film-rupturing agent that satisfies the condition (3) therefor is referred to as the "vapor film-rupturing agent (3)".

The vapor film-rupturing agents (1) to (3) are totally referred to as the "vapor film-rupturing agent of the present invention".

While the vapor film-rupturing agent of the present invention is prepared to have the fraction (x) (% by mass) of the saturated component and the fraction (y) (% by mass) of the asphaltene component that satisfy one or more of the conditions (1) to (3), the vapor film-rupturing agent is preferably prepared to satisfy any two of the conditions (1) to (3), and more preferably prepared to satisfy all the conditions (1) to (3).

The vapor film-rupturing agents (1) to (3) as one embodiment of the present invention will be described below.

<Vapor Film-Rupturing Agent (1)>

The vapor film-rupturing agent (1) as one embodiment of the present invention is a vapor film-rupturing agent that is prepared from asphalt as a staring material, so as to have a fraction (x) (% by mass) of a saturated component and a fraction (y) (% by mass) of an asphaltene component that satisfy the condition (1).

Specifically, the vapor film-rupturing agent (1) as one embodiment of the present invention is a vapor film-rupturing agent that is prepared from asphalt as a staring material, so as to have a value T calculated from the following calculation expression (I) of 2.4000 or less.

$$T=1.2926\times x/100-8.113\times y/100+2.3384\quad \text{Calculation expression (I)}$$

In the calculation expression (I), x and y respectively represent the fraction (x) (% by mass) of the saturated component and the fraction (y) (% by mass) of the asphaltene component based on the total fraction 100% by mass of the saturated component, the asphaltene component, the aromatic component, and the resin component in the vaper film-rupturing agent (which may be hereinafter referred to as the "total fraction of the four components") obtained by any one of analysis methods described in the Japan Petroleum Institute Standard and Manuals Testing Method for Petroleum Products JPI-5S-70-10 and the British Standard Test Method IP-469.

The present inventors have had knowledge that the saturated component in the vapor film-rupturing agent prepared from asphalt as a starting material is a factor reducing the vapor film-rupturing effect of the thermal treatment oil composition, and the asphaltene component therein is a factor enhancing the vapor film-rupturing effect thereof.

Based on the knowledge, the present inventors have collected a large amount of data for the relationship between the fraction of the saturated component and the fraction of the asphaltene component in the vapor film-rupturing agent prepared from asphalt as a starting material and the characteristic number of seconds of the thermal treatment oil composition using the vapor film-rupturing agent. The calculation expression (I) is obtained from the data.

Specifically, the present inventors have found that the vapor film-rupturing agent (1) is prepared by controlling the fraction of the saturated component and the fraction of the asphaltene component so that the vapor film-rupturing agent (1) has a value T of 2.4000 or less calculated from the calculation expression (I), and the thermal treatment oil composition using the vapor film-rupturing agent (1) achieves a characteristic number of seconds of 2.50 seconds or less.

The vapor film-rupturing agent (1) as one embodiment of the present invention has been completed based on the knowledge.

The value T calculated from the calculation expression (I) is 2.4000 or less, and is preferably 2.1000 or less, more preferably 1.8000 or less, further preferably 1.7000 or less, still further preferably 1.5000 or less, and still more further preferably 1.2500 or less, from the standpoint of providing the vapor film-rupturing agent capable of providing a thermal treatment oil composition having an excellent vapor film-rupturing effect.

The lower limit of the value T is not particularly determined, and the value T is preferably 0.01 or more from the standpoint of the productivity of the vapor film-rupturing agent.

In the vapor film-rupturing agent (1) as one embodiment of the present invention, the fraction (x) of the saturated component is preferably from 0 to 40.0% by mass, more preferably from 0 to 30.0% by mass, further preferably from 0 to 25.0% by mass, still further preferably from 0 to 15.0% by mass, and still more further preferably from 0 to 10.0% by mass, from the standpoint of providing the vapor film-rupturing agent capable of providing a thermal treatment oil composition having an excellent vapor film-rupturing effect.

In the vapor film-rupturing agent (1) as one embodiment of the present invention, the fraction (y) of the asphaltene component is preferably 3.0% by mass or more, more preferably 5.0% by mass or more, further preferably 7.0% by mass or more, still further preferably 10.0% by mass or more, and still more further preferably 14.5% by mass or more, from the standpoint of providing the vapor film-rupturing agent capable of providing a thermal treatment oil composition having an excellent vapor film-rupturing effect.

The upper limit of the fraction (y) of the asphaltene component is not particularly limited, and the fraction (y) of the asphaltene component is preferably 30.0% by mass or less, and more preferably 20.0% by mass or less, from the standpoint of the productivity of the vapor film-rupturing agent.

In the vapor film-rupturing agent (1) as one embodiment of the present invention, the fraction (z) of the aromatic component based on the total fraction 100% by mass of the four components obtained by the aforementioned analysis method is not particularly limited as far as the value T calculated from the calculation expression (I) is in the aforementioned range, and is preferably from 20 to 90% by mass, and more preferably from 30 to 90% by mass.

In the vapor film-rupturing agent (1) as one embodiment of the present invention, the fraction (w) of the resin component based on the total fraction 100% by mass of the four components obtained by the aforementioned analysis method is not particularly limited as far as the value T calculated from the calculation expression (I) is in the aforementioned range, and is preferably from 5 to 60% by mass, and more preferably from 10 to 60% by mass.

<Vapor Film-Rupturing Agent (2) satisfying Condition (2)>

The vapor film-rupturing agent (2) as one embodiment of the present invention is a vapor film-rupturing agent that is prepared from asphalt as a staring material, so as to have a fraction (x) (% by mass) of a saturated component that satisfies the condition (2).

Specifically, the vapor film-rupturing agent (2) as one embodiment of the present invention is a vapor film-rupturing agent that prepared from asphalt as a starting material, and has the fraction (y) of the asphaltene component based on the total fraction 100% by mass of the saturated component, the asphaltene component, the aromatic component, and the resin component (which may be hereinafter referred to as the "total fraction of the four components") obtained by any one of analysis methods described in the Japan Petroleum Institute Standard and Manuals Testing Method for Petroleum Products JPI-5S-70-10 and the British Standard Test Method IP-469, of 7.0% by mass or more.

The vapor film-rupturing agent (2) as one embodiment of the present invention has been completed based on the knowledge that the asphaltene component in the vapor film-rupturing agent prepared from asphalt as a starting material contributes to the enhancement of the vapor film-rupturing effect of the thermal treatment oil composition.

Specifically, it is considered that the thermal treatment oil composition containing the vapor film-rupturing agent (2) as one embodiment of the present invention has a high vapor film-rupturing effect with a characteristic number of seconds of 2.00 seconds or less since the vapor film-rupturing agent (2) is prepared to make the fraction (y) of the asphaltene component, which is considered to contribute to the enhancement of the vapor film-rupturing effect, of 7.0% by mass or more.

In the vapor film-rupturing agent (2) as one embodiment of the present invention, the fraction (y) of the asphaltene component is preferably 9.0% by mass or more, more preferably 10.5% by mass or more, further preferably 12.0% by mass or more, and still further preferably 14.5% by mass or more, from the aforementioned standpoint.

The upper limit of the fraction (y) of the asphaltene component is not particularly determined, and the fraction (y) of the asphaltene component is preferably 30.0% by mass or less, and more preferably 20.0% by mass or less, from the standpoint of the productivity of the vapor film-rupturing agent.

In the vapor film-rupturing agent (2) as one embodiment of the present invention, the fraction (x) of the saturated component based on the total fraction 100% by mass of the four components obtained by the aforementioned analysis method is preferably from 0 to 40.0% by mass, more preferably from 0 to 30.0% by mass, further preferably from 0 to 25.0% by mass, still further preferably from 0 to 15.0% by mass, and still more further preferably from 0 to 10.0% by mass, from the standpoint of providing the vapor film-rupturing agent capable of providing a thermal treatment oil composition having an excellent vapor film-rupturing effect.

In the vapor film-rupturing agent (2) as one embodiment of the present invention, the fraction (z) of the aromatic component based on the total fraction 100% by mass of the four components obtained by the aforementioned analysis method is not particularly limited as far as the condition (2) is satisfied, and is preferably from 20 to 90% by mass, and more preferably from 30 to 90% by mass.

In the vapor film-rupturing agent (2) as one embodiment of the present invention, the fraction (w) of the resin component based on the total fraction 100% by mass of the four components obtained by the aforementioned analysis method is not particularly limited as far as the condition (2) is satisfied, and is preferably from 5 to 60% by mass, and more preferably from 10 to 60% by mass.

<Vapor Film-Rupturing Agent (3) satisfying Condition (3)>

The vapor film-rupturing agent (3) as one embodiment of the present invention is a vapor film-rupturing agent that is prepared from asphalt as a staring material, so as to have a fraction (x) (% by mass) of a saturated component and a fraction (y) (% by mass) of an asphaltene component that satisfy the condition (3).

Specifically, the vapor film-rupturing agent (3) as one embodiment of the present invention is a vapor film-rupturing agent that prepared from asphalt as a starting material, and has the ratio ((y)/(x)) of the fraction (y) of the asphaltene component and the fraction (x) of the saturated component based on the total fraction 100% by mass of the saturated component, the asphaltene component, the aromatic component, and the resin component obtained by any one of analysis methods described in the Japan Petroleum Institute Standard and Manuals Testing Method for Petroleum Products JPI-5S-70-10 and the British Standard Test Method IP-469, of 0.5 or more.

The present inventors have had knowledge that the saturated component in the vapor film-rupturing agent prepared from asphalt as a starting material may be a factor reducing the vapor film-rupturing effect of the thermal treatment oil composition.

Based on the knowledge, the present inventors have considered that the vapor film-rupturing effect of the thermal treatment oil composition can be enhanced irrespective of the extent of the value of the fraction (y) of the asphaltene component by performing the preparation in such a manner that the asphaltene component contributing to the vapor film-rupturing effect of the thermal treatment oil composition is contained sufficiently with respect to the saturated component reducing the effect.

Specifically, it is considered that the thermal treatment oil composition containing the vapor film-rupturing agent (3) as one embodiment of the present invention has a high vapor film-rupturing effect with a characteristic number of seconds of 2.00 seconds or less since a ratio ((y)/(x)) of the fraction (y) of the asphaltene component and the fraction (x) of the saturated component is 0.5 or more, and the asphaltene component is contained sufficiently with respect to the saturated component.

In the vapor film-rupturing agent (3) of the present invention, the ratio ((y)/(x)) of the fraction (y) of the asphaltene component and the fraction (x) of the saturated component is preferably 0.80 or more, more preferably 0.85 or more, further preferably 1.50 or more, and still further preferably 3.00 or more, from the aforementioned standpoint.

The ratio ((y)/(x)) is preferably 50.0 or less, more preferably 20.0 or less, and further preferably 10.0 or less, from the standpoint of the productivity of the vapor film-rupturing agent.

In the vapor film-rupturing agent (3) of the present invention, the fraction (x) of the saturated component based on the total fraction 100% by mass of the four components obtained by the aforementioned analysis method is preferably from 0 to 25.0% by mass, more preferably from 0 to 15.0% by mass, and further preferably from 0 to 10.0% by mass from the standpoint described above.

In the vapor film-rupturing agent (3) as one embodiment of the present invention, the fraction (z) of the aromatic component based on the total fraction 100% by mass of the four components obtained by the aforementioned analysis method is not particularly limited as far as the condition (3) is satisfied, and is preferably from 20 to 90% by mass, and more preferably from 30 to 90% by mass.

In the vapor film-rupturing agent (3) as one embodiment of the present invention, the fraction (w) of the resin component based on the total fraction 100% by mass of the four components obtained by the aforementioned analysis method is not particularly limited as far as the condition (3) is satisfied, and is preferably from 5 to 60% by mass, and more preferably from 10 to 60% by mass.

<Common Matters of Vapor Film-Rupturing Agents (1) to (3)>

In the vapor film-rupturing agents (1) to (3) of the present invention, the fractions of the saturated component and the asphaltene component can be adjusted, for example, by considering the following matters.

Since the asphaltene component is insoluble in n-heptane, the fraction of the asphaltene component can be increased in such a manner that n-heptane is added to asphalt as the starting material, and the filtered material is collected.

The fraction of the asphaltene component can also be increased in such a manner that a mixed solvent of propane and butane is added to asphalt, which is separated from the deasphalted oil.

The fraction of the asphaltene component can be increased by decreasing the fraction of the saturated component by developing asphalt in column chromatography having silica gel or alumina filled therein with sequentially from a non-polar solvent, such as heptane, to a polar solvent, such as toluene, dichloromethane, and methanol.

In the vapor film-rupturing agents (1) to (3) of the present invention, the content of the remaining coal is preferably from 8.0 to 40.0% by mass, more preferably from 10.0 to 37.0% by mass, further preferably from 13.0 to 35.0% by mass, and still further preferably from 16.0 to 30.0% by mass, based on the total amount (100% by mass) of the vapor film-rupturing agent.

The thermal treatment oil composition containing the vapor film-rupturing agent that has a content of the remaining coal within the range can further decrease the characteristic number of seconds, and can exhibit a higher vapor film-rupturing effect.

In the present invention, the "remaining coal" means a carbonized residue in the form of coke remaining after a heating process, such as distillation, which is a compound derived from a crude oil, and has the same meaning as "residual carbon".

In the description herein, the content of the remaining coal contained in the vapor film-rupturing agent means a value that is measured according to JIS K2270-2 (2009) (micro method).

The content of the remaining coal tends to increase when the fraction (x) of the saturated component is smaller, and when the fraction (y) of the asphaltene component is larger. Accordingly, the content of the remaining coal can be adjusted by referring to the aforementioned adjusting methods of the fractions of the saturated component and the asphaltene component.

[Thermal Treatment Oil Composition]

The thermal treatment oil composition of the present invention contains the aforementioned vapor film-rupturing agent of the present invention and a base oil, and may further contain an additive for a thermal treatment oil depending on necessity.

In the thermal treatment oil composition of one embodiment of the present invention, the content of the vapor film-rupturing agent of the present invention is preferably from 0.1 to 20% by mass, more preferably from 0.2 to 18% by mass, further preferably from 0.3 to 15% by mass, and still further preferably from 0.5 to 12% by mass, based on the total amount (100% by mass) of the thermal treatment oil composition.

The thermal treatment oil composition of one embodiment of the present invention may contain an additional vapor film-rupturing agent that does not correspond to the aforementioned vapor film-rupturing agent of the present invention in such a range that does not impair the advantageous effects.

Examples of the additional vapor film-rupturing agent include a polymer having a weight average molecular weight of from 5,000 to 100,000, such as an ethylene-α-olefin copolymer, a polyolefin and a polymethacrylate, and a residual oil separated from asphalt that does not correspond to the vapor film-rupturing agent of the present invention.

The content ratio of the vapor film-rupturing agent of the present invention based on the total amount (100% by mass) of the vapor film-rupturing agent contained in the thermal treatment oil composition of one embodiment of the present invention is preferably from 80 to 100% by mass, more preferably from 90 to 100% by mass, further preferably from 95 to 100% by mass, and still further preferably from 99 to 100% by mass.

The thermal treatment oil composition containing the polymer as a vapor film-rupturing agent has a tendency that the main chain of the polymer is broken to lower the vapor film-rupturing effect during the continuous use thereof, and thus has a problem in durability. Accordingly, the content of the polymer is preferably small.

In the thermal treatment oil composition of one embodiment of the present invention, the content of the polymer is preferably from 0 to 20 parts by mass, more preferably from 0 to 10 parts by mass, further preferably from 0 to 5 parts by mass, and still further preferably from 0 to 1 part by mass, per 100 parts by mass of the vapor film-rupturing agent of the present invention contained in the thermal treatment oil composition.

<Base Oil>

The base oil used in one embodiment of the present invention is not particularly limited, and any of a mineral oil and a synthetic oil can be used.

The base oil used in one embodiment of the present invention may be used solely or as a combination of two or more kinds thereof.

Examples of the mineral oil include a paraffin mineral oil and a naphthene mineral oil, and more specifically include an oil obtained by subjecting a fraction obtained by distillation under reduced pressure of an atmospheric residual oil obtained by atmospheric distillation of a crude oil to refining by performing one or more treatment of solvent deasphaltation, solvent extraction, hydrogenolysis, solvent dewaxing, hydrogen refining, and the like, and a wax-isomerized mineral oil.

In the mineral oil, a highly refined mineral oil is preferably used from the standpoint of providing a lubricating oil composition having a decreased content of a sulfur component. The highly refined mineral oil can be obtained by subjecting a heavy fraction obtained from a crude oil to hydrogen refining or hydrogenolysis.

Examples of the synthetic oil include a poly-α-olefin compound, a polyphenyl ether, an alkylbenzene, an alkylnaphthalene, a polyphenyl hydrocarbon, an ester oil (such as a fatty acid ester of a polyhydric alcohol, such as neopentyl glycol, trimethylolpropane, and pentaerythritol), a glycol synthetic oil, and GTL (gas to liquids).

The kinematic viscosity at 40° C. of the base oil used in one embodiment of the present invention is preferably from 5 to 600 $mm^2/s$, more preferably from 6 to 570 $mm^2/s$, further preferably from 7 to 540 $mm^2/s$, still further preferably from 8 to 500 $mm^2/s$, and particularly preferably from 9 to 480 $mm^2/s$.

When the kinematic viscosity at 40° C. of the base oil is 5 $mm^2/s$ or more, the flash point thereof can be retained high to provide a thermal treatment oil composition suppressed in formation of oil smoke. When the kinematic viscosity at 40° C. of the base oil is 600 $mm^2/s$ or less, a thermal treatment oil composition having a good cooling capability can be obtained.

In the description herein, the kinematic viscosity at 40° C. is a value that is measured according to JIS K2283 (2000).

The viscosity index of the base oil used in one embodiment of the present invention is preferably 85 or more, more preferably 95 or more, and further preferably 105 or more, from the standpoint of the oxidation stability.

In the description herein, the viscosity index is a value that is measured according to JIS K2283 (2000).

In the thermal treatment oil composition of one embodiment of the present invention, the content of the base oil is preferably from 80 to 99.99% by mass, more preferably from 82 to 99.9% by mass, further preferably from 85 to 99.9% by mass, and still further preferably from 88 to 99.0% by mass, based on the total amount (100% by mass) of the thermal treatment oil composition.

<Additive for Thermal Treatment Oil>

The thermal treatment oil composition of one embodiment of the present invention may contain an additive for a thermal treatment oil that is used in an ordinary thermal treatment oil composition in such a range that does not impair the advantageous effects.

The thermal treatment oil composition of one embodiment of the present invention preferably contains one or more additives for a thermal treatment oil selected from the group consisting of an antioxidant, a detergent, a dispersant, a glitter enhancing agent, and a thermal decomposition retarder.

In one embodiment of the present invention, a package additive containing plural additives for a thermal treatment oil may also be used.

In the thermal treatment oil composition of one embodiment of the present invention, the total content of the additives for a thermal treatment oil except for the vapor film-rupturing agent is preferably from 0 to 20% by mass, more preferably from 0 to 18% by mass, and further preferably from 0 to 15% by mass, based on the total amount (100% by mass) of the thermal treatment oil composition.

The aforementioned content is the total content of the additives for a thermal treatment oil "except for the vapor film-rupturing agent", and the case where the content is "0% by mass" means the thermal treatment oil composition that contains only the base oil and the vapor film-rupturing agent but does not contain an additive for a thermal treatment oil except for the vapor film-rupturing agent.

(Antioxidant)

The antioxidant, for example, has a function of preventing the formation of sludge in the repeated use of the thermal treatment oil composition.

Examples of the antioxidant include a phenol antioxidant and an amine antioxidant.

Examples of the phenol antioxidant include a monocyclic phenol compound, such as 2,6-di-tert-butyl-4-methylphenol, 2,6-di-tert-butyl-4-ethylphenol, 2,4,6-tri-tert-butylphenol, 2,6-di-tert-butyl-4-hydroxymethylphenol, 2,6-di-tert-butylphenol, 2,4-dimethyl-6-tert-butylphenol, 2,6-di-tert-butyl-4-(N,N-dimethylaminomethyl)phenol, 2,6-di-tert-amyl-4-methylphenol, and n-octadecyl-3-(4-hydroxy-3,5-di-tert-butylphenyl) propionate; and a polycyclic phenol compound, such as 4,4'-methylenebis(2,6-di-tert-butylphenol), 4,4'-isopropylidenebis(2,6-di-tert-butylphenol), 2,2'-methylenebis(4-methyl-6-tert-butylphenol), 4,4'-bis(2,6-di-tert-butylphenol), 4,4'-bis(2-methyl-6-tert-butylphenol), 2,2'-methylenebis(4-ethyl-6-tert-butylophenol), 4,4'-butylidenebis(3-methyl-6-tert-butylphenol), 2,2'-thiobis(4-methyl-6-tert-butylphenol), and 4,4'-thiobis(3-methyl-6-tert-butylphenol).

Examples of the amine antioxidant include a diphenylamine antioxidant and a naphthylamine antioxidant.

Examples of the diphenylamine antioxidant include an alkylated diphenylamine having an alkyl group having from 3 to 20 carbon atoms, and specifically include diphenylamine, monooctyldiphenylamine, monononyldiphenylamine, 4,4'-dibutyldiphenylamine, 4,4'-dihexyldiphenylamine, 4,4'-dioctyldiphenylamine, 4,4'-dinonyldiphenylamine, tetrabutyldiphenylamine, tetrahexyldiphenylamine, tetraoctyldiphenylamine, and tetranonyldiphenylamine.

Examples of the naphthylamine antioxidant include a phenyl-α-naphthylamine substituted with an alkyl group having from 3 to 20 carbon atoms, and specifically include α-naphthylamine, phenyl-α-naphthylamine, butylphenyl-α-naphthylamine, hexylphenyl-α-naphthylamine, octylphenyl-α-naphthylamine, and nonylphenyl-α-naphthylamine.

The antioxidant may be used solely or as a combination of two or more kinds thereof.

The content of the antioxidant is preferably from 0.01 to 10% by mass, more preferably from 0.03 to 5% by mass, and further preferably from 0.05 to 3% by mass, based on the total amount (100% by mass) of the thermal treatment oil composition from the standpoint of the balance between the antioxidant effect and the economic efficiency, and the like.

(Detergent)

The detergent has a function of enhancing the effect of dispersing sludge formed in the repeated use of the thermal treatment oil composition, and in particular, a metal detergent also has a function as a neutralizing agent for the deteriorated acid.

Examples of the detergent include a metal detergent, and specifically include a neutral metal sulfonate, a neutral metal phenate, a neutral metal salicylate, a neutral metal phosphonate, a basic sulfonate, a basic phenate, a basic salicylate, an overbased sulfonate, an overbased salicylate, and an overbased phosphonate.

The detergent may be used solely or as a combination of two or more kinds thereof.

The content of the detergent is preferably from 0.01 to 5% by mass, and more preferably from 0.02 to 3% by mass, based on the total amount (100% by mass) of the thermal treatment oil composition.

(Dispersant)

The dispersant has a function of enhancing the effect of dispersing sludge formed in the repeated use of the thermal treatment oil composition.

Examples of the dispersant include an ashless dispersant, and specifically include an alkenyl succinimide compound, a boron-containing alkenyl succinimide compound, a benzylamine compound, a boron-containing benzylamide compound, a succinate ester compound, and an amide compound of a monobasic or dibasic carboxylic acid represented by a fatty acid and succinic acid.

The dispersant may be used solely or as a combination of two or more kinds thereof.

The content of the dispersant is preferably from 0.01 to 5% by mass, and more preferably from 0.02 to 3% by mass, based on the total amount (100% by mass) of the thermal treatment oil composition.

(Glitter Enhancing Agent)

Examples of the glitter enhancing agent include a fat and oil, a fatty acid, an alkenyl succinimide, and a substituted hydroxyaromatic carboxylate ester derivative.

The glitter enhancing agent may be used solely or as a combination of two or more kinds thereof.

The content of the glitter enhancing agent is preferably from 0.01 to 5% by mass, and more preferably from 0.02 to 3% by mass, based on the total amount (100% by mass) of the thermal treatment oil composition.

(Thermal Decomposition Retarder)

Examples of the thermal decomposition retarder include diphenyl monosulfide, diphenyl disulfide, and dibutylhydroxytoluene.

The thermal decomposition retarder may be used solely or as a combination of two or more kinds thereof.

The content of the thermal decomposition retarder is preferably from 0.01 to 5% by mass, and more preferably from 0.02 to 3% by mass, based on the total amount (100% by mass) of the thermal treatment oil composition.

<Properties of Thermal Treatment Oil Composition>

The characteristic number of seconds in the cooling capability test according to JIS K2242 (2012) of the thermal treatment oil composition of one embodiment of the present invention is preferably 2.50 seconds or less, more preferably 2.00 seconds or less, further preferably 1.90 seconds or less, still further preferably 1.50 seconds or less, still more further preferably 1.10 seconds or less, and particularly preferably 1.00 second or less.

The characteristic number of seconds of the thermal treatment oil composition containing the vapor film-rupturing agent (1) as one embodiment of the present invention is preferably 2.50 seconds or less, more preferably 1.90 seconds or less, further preferably 1.50 seconds or less, and still further preferably 1.10 seconds or less.

The characteristic number of seconds of the thermal treatment oil composition containing the vapor film-rupturing agent (2) or (3) as one embodiment of the present invention is preferably 2.00 seconds or less, more preferably 1.50 seconds or less, and further preferably 1.00 second or less.

The characteristic number of seconds is preferably as small as possible, and is more than 0 second.

The thermal treatment oil composition of the present invention contains the vapor film-rupturing agent of the present invention and the base oil, and therefore the characteristic number of seconds thereof can be adjusted to the aforementioned value or less, so as to provide a high vapor film-rupturing effect.

The kinetic viscosity at 40° C. of the thermal treatment oil composition of one embodiment of the present invention is preferably from 5 to 400 $mm^2/s$, more preferably from 7 to 380 $mm^2/s$, further preferably from 10 to 350 $mm^2/s$, and still further preferably from 12 to 320 $mm^2/s$.

When the kinematic viscosity at 40° C. of the thermal treatment oil composition is 5 $mm^2/s$ or more, the flash point thereof can be retained high to provide a thermal treatment oil composition suppressed in formation of oil smoke. When the kinematic viscosity of the thermal treatment oil composition is 400 $mm^2/s$ or less, a thermal treatment oil composition having a good cooling capability can be obtained.

The viscosity index of the thermal treatment oil composition of one embodiment of the present invention is preferably 100 or more, more preferably 105 or more, and further preferably 110 or more, from the standpoint of the oxidation stability.

The flash point of the thermal treatment oil composition of one embodiment of the present invention is preferably 150° C. or more, and more preferably 170° C. or more, from the standpoint of providing a thermal treatment oil composition that is reduced in risk of flash and simultaneously is capable of suppressing formation of oil smoke in the thermal treatment.

In the description herein, the flash point is a value that is measured according to JIS K2265-1 (2007) (test method for flash point by tag closed cup tester).

The content of a sulfur component of the thermal treatment oil composition of one embodiment of the present invention is preferably 300 ppm by mass or less, more preferably 200 ppm by mass or less, and further preferably 100 ppm by mass or less, from the standpoint of providing a thermal treatment oil composition capable of suppressing the formation of sludge.

In the description herein, the content of a sulfur component is a value that is measured according to JIS K2541-3 (2003) (quartz tube combustion air method).

<Applications of Thermal Treatment Oil Composition>

The thermal treatment oil composition of the present invention can exhibit an excellent cooling capability in a thermal treatment of a metal material, and therefore can be favorably used as a thermal treatment oil for quenching of various alloy steels, such as a carbon steel, a nickel-manganese steel, a chromium-molybdenum steel, and a manganese steel.

The temperature range of the thermal treatment oil composition of the present invention in the case where a metal material, such as a steel material, is subjected to a quenching treatment by using the thermal treatment oil composition may be set to a range of from 60 to 150° C., which is the temperature for the ordinary quenching treatment, and may be set to a higher temperature of 150° C. or more.

EXAMPLES

The present invention will be described more specifically with reference to examples below, but the present invention is not limited to the examples.

[Evaluation of Properties and Capabilities]

(1) Fractions of Components in Vapor Film-Rupturing Agent

The fractions of the saturated component, the asphaltene component, the aromatic component, and the resin component in the vapor film-rupturing agent were measured according to the method described in the British Standard Test Method IP-469. Then, the fraction (x) of the saturated component, the fraction (y) of the asphaltene component, the fraction (z) of the aromatic component, and the fraction (w) of the resin component, based on the total fraction 100% by mass of the four components each were calculated.

(2) Content of Remaining Coal in Vapor Film-Rupturing Agent

The content of the remaining coal was measured according to JIS K2270-2 (2009) (micro method).

(3) Kinematic Viscosity

The kinematic viscosity was measured according to JIS K2283 (2000) (ASTM D445).

(4) Viscosity Index

The viscosity index was measured according to JIS K2283 (2000) (ASTM D445).

(5) Characteristic Number of Seconds

The characteristic number of seconds was measured by performing the cooling capability test according to JIS K2242 (2012).

Examples 1a to 20a and Comparative Examples 1a and 2a (1) Preparation of Vapor Film-Rupturing Agents Plural kinds of starting asphalt materials were prepared by appropriately combining residues of crude oils from various sources. In consideration of the tendency in the adjustment of the fraction (x) of the saturated component and the fraction (y) of the asphaltene component, the starting asphalt materials each were subjected to at least one refining step of a refining step by distillation, a filtering step after refluxing with n-heptane, and a refining step by alumina column chromatography using a developing solvent selected from n-heptane as a non-polar solvent, and toluene, dichloromethane, and methanol as polar solvents, thereby preparing vapor film-rupturing agents (A-a) to (V-a) having the fraction (x) of the saturated component, the fraction (y) of the asphaltene component, the fraction (z) of the aromatic component, and the fraction (w) of the resin component shown in Table 1.

For example, the vapor film-rupturing agents (F-a), (Q-a), and (U-a) were prepared in the following manner.

61.1 g of the starting asphalt material and 1,830 mL of n-heptane were placed in a round-bottom flask, and after attaching a reflux condenser thereto, were heated under refluxing for 1 hour. After terminating the refluxing and spontaneously cooling by standing still at room temperature (25° C.) for 12 hours, the mixture was filtered with a press filter, and the filtrate was collected.

Subsequently, after filling 1 kg of activated alumina in a column tube, and wetting the activated alumina with n-heptane, the filtrate was passed through the column tube, and 4 L of n-heptane, 4 L of toluene, 4 L of a mixed solvent of methanol and dichloromethane (1/1 by volume) as developing solvents were charged in this order, thereby collecting each of the fraction eluted by n-heptane, the fraction eluted by toluene, and the fraction eluted by the mixed solvent of methanol and dichloromethane.

The solvents of the eluted fractions were distilled off under reduced pressure, and thereby 24.4 g of the vapor film-rupturing agent (U-a) was obtained from the fraction eluted by n-heptane, 30.8 g of the vapor film-rupturing agent (F-a) was obtained from the fraction eluted by toluene, and 6.7 g of the vapor film-rupturing agent (Q-a) was obtained from the fraction eluted by the mixed solvent of methanol and dichloromethane.

The values T of the vapor film-rupturing agents (A-a) to (V-a), which were calculated by substituting the fractions (x) of the saturated component and the fractions (y) of the asphaltene component into x and y in the calculation expression (I), were as shown in Table 1.

(2) Preparation of Thermal Treatment Oil Compositions 94 parts by mass of a 70N mineral oil (kinematic viscosity at 40° C.: 15 $mm^2/s$, viscosity index: 95) and 6 parts by mass of the vapor film-rupturing agents (A-a) to (V-a) were blended and agitated to prepare thermal treatment oil compositions.

The thermal treatment oil compositions thus prepared were measured for the characteristic number of seconds, the kinematic viscosity at 40° C., and the viscosity index according to the methods described above. The thermal treatment oil compositions were evaluated for the vapor film-rupturing effect based on the values of the characteristic number of seconds thus measured, according to the following standard. The results are shown in Table 1.

AA: The characteristic number of seconds was 1.50 seconds or less.

A: The characteristic number of seconds was more than 1.50 seconds and 1.90 seconds or less.

B: The characteristic number of seconds was more than 1.90 seconds and 2.50 seconds or less.

C: The characteristic number of seconds was more than 2.50 seconds.

TABLE 1

| | Vapor film-rupturing agent | | | | | | | | Evaluation of thermal trealment oil composition | | | |
|---|---|---|---|---|---|---|---|---|---|---|---|---|
| | | Fractions of four components | | | | | Value of T | | | | | |
| | Kind | Fraction (x) of saturated component % by mass | Fraction (y) of asphaltene component % by mass | Fraction (z) of aromatic component % by mass | Fraction (w) of resin component % by mass | Total % by mass | calculated from calculation expression (I) — | Remaining coal % by mass | Characteristic number of seconds second | Evaluation of vapor film-rupturing effect — | Kinematic viscosity at 40° C. $mm^2/s$ | Viscosity index — |
| Example 1a | (A-a) | 23.4 | 3.9 | 59.8 | 12.9 | 100.0 | 2.3245 | 12.7 | 1.93 | B | 18.41 | 112 |
| Example 2a | (B-a) | 29.8 | 5.2 | 41.6 | 23.4 | 100.0 | 2.3017 | 9.7 | 2.25 | B | 17.86 | 120 |
| Example 3a | (C-a) | 23.0 | 4.4 | 59.0 | 13.6 | 100.0 | 2.2787 | 12.6 | 1.91 | B | 18.45 | 111 |
| Example 4a | (D-a) | 22.9 | 4.4 | 58.6 | 14.1 | 100.0 | 2.2774 | 12.4 | 1.95 | B | 18.50 | 112 |
| Example 5a | (E-a) | 23.0 | 5.5 | 57.3 | 14.2 | 100.0 | 2.1895 | 13.6 | 1.94 | B | 18.07 | 110 |
| Example 6a | (F-a) | 0.8 | 4.2 | 73.5 | 21.5 | 100.0 | 2.0080 | 17.3 | 1.95 | B | 18.63 | 111 |
| Example 7a | (G-a) | 14.5 | 9.6 | 62.6 | 13.3 | 100.0 | 1.7470 | 18.2 | 1.90 | A | 17.58 | 104 |
| Example 8a | (H-a) | 14.0 | 9.7 | 59.8 | 16.5 | 100.0 | 1.7324 | 16.3 | 1.83 | A | 17.27 | 103 |
| Example 9a | (I-a) | 14.1 | 10.3 | 58.0 | 17.6 | 100.0 | 1.6850 | 17.2 | 1.71 | A | 17.24 | 103 |
| Example 10a | (J-a) | 14.3 | 10.5 | 55.8 | 19.4 | 100.0 | 1.6714 | 17.0 | 1.65 | A | 17.30 | 103 |
| Example 11a | (K-a) | 13.7 | 11.0 | 57.7 | 17.6 | 100.0 | 1.6231 | 17.0 | 1.60 | A | 17.23 | 103 |
| Example 12a | (L-a) | 2.6 | 14.2 | 58.4 | 24.8 | 100.0 | 1.2200 | 26.9 | 1.13 | AA | 17.98 | 103 |
| Example 13a | (M-a) | 2.3 | 14.7 | 58.7 | 24.3 | 100.0 | 1.1755 | 28.7 | 1.01 | AA | 17.98 | 103 |
| Example 14a | (N-a) | 2.7 | 14.8 | 57.3 | 25.2 | 100.0 | 1.1726 | 27.9 | 0.98 | AA | 17.94 | 104 |
| Example 15a | (O-a) | 2.6 | 15.6 | 59.8 | 22.0 | 100.0 | 1.1064 | 28.2 | 1.01 | AA | 17.91 | 104 |
| Example 16a | (P-a) | 2.6 | 16.2 | 57.3 | 23.9 | 100.0 | 1.0577 | 26.9 | 1.00 | AA | 18.06 | 104 |
| Example 17a | (Q-a) | 0.0 | 16.5 | 31.9 | 51.6 | 100.0 | 0.9998 | 33.2 | 1.43 | AA | 18.99 | 113 |
| Example 18a | (R-a) | 24.5 | 21.6 | 32.9 | 21.0 | 100.0 | 0.9027 | 19.3 | 1.06 | AA | 18.28 | 105 |
| Example 19a | (S-a) | 12.3 | 11.9 | 56.3 | 19.5 | 100.0 | 1.5319 | 17.6 | 1.43 | AA | 17.42 | 103 |
| Example 20a | (T-a) | 5.8 | 19.6 | 51.3 | 23.3 | 100.0 | 0.8232 | 27.0 | 0.68 | AA | 17.38 | 105 |
| Comparative Example 1a | (U-a) | 57.0 | 0.4 | 36.4 | 6.2 | 100.0 | 3.0427 | 0.4 | 2.89 | C | 17.89 | 112 |
| Comparative Example 2a | (V-a) | 24.1 | 2.3 | 56.1 | 17.5 | 100.0 | 2.4633 | 6.9 | 2.86 | C | 17.90 | 101 |

As shown in Table 1, such results were obtained that the thermal treatment oil compositions containing any of the vapor film-rupturing agents (A-a) to (T-a) prepared in Examples 1a to 20a had a characteristic number of seconds of 2.50 seconds or less and had a high vapor film-rupturing effect.

Examples 1b to 17b, Comparative Examples 1b and 2b, and Reference Example 3b (1) Preparation of Vapor Film-Rupturing Agents Plural kinds of starting asphalt materials were prepared by appropriately combining residues of crude oils from various sources. In consideration of the tendency in the adjustment of the fraction (x) of the saturated component and the fraction (y) of the asphaltene component, the starting asphalt materials each were subjected to at least one refining step of a refining step by distillation, a filtering step after refluxing with n-heptane, and a refining step by alumina column chromatography using a developing solvent selected from n-heptane as a non-polar solvent, and toluene, dichloromethane, and methanol as polar solvents, thereby preparing vapor film-rupturing agents (A-b) to (T-b) having the fraction (x) of the saturated component, the fraction (y) of the asphaltene component, the fraction (z) of the aromatic component, and the fraction (w) of the resin component shown in Table 2.

For example, the vapor film-rupturing agents (M-b), (Q-b), and (R-b) were prepared in the following manner.

61.1 g of the starting asphalt material and 1,830 mL of n-heptane were placed in a round-bottom flask, and after attaching a reflux condenser thereto, were heated under refluxing for 1 hour. After terminating the refluxing and spontaneously cooling by standing still at room temperature (25° C.) for 12 hours, the mixture was filtered with a press filter, and the filtrate was collected.

Subsequently, after filling 1 kg of activated alumina in a column tube, and wetting the activated alumina with n-heptane, the filtrate was passed through the column tube, and 4 L of n-heptane, 4 L of toluene, 4 L of a mixed solvent of methanol and dichloromethane (1/1 by volume) as developing solvents were charged in this order, thereby collecting each of the fraction eluted by n-heptane, the fraction eluted by toluene, and the fraction eluted by the mixed solvent of methanol and dichloromethane.

The solvents of the eluted fractions were distilled off under reduced pressure, and thereby 24.4 g of the vapor film-rupturing agent (R-b) was obtained from the fraction eluted by n-heptane, 30.8 g of the vapor film-rupturing agent (Q-b) was obtained from the fraction eluted by toluene, and 6.7 g of the vapor film-rupturing agent (M-b) was obtained from the fraction eluted by the mixed solvent of methanol and dichloromethane.

(2) Preparation of Thermal Treatment Oil Compositions 94 parts by mass of a 70N mineral oil (kinematic viscosity at 40° C.: 15 $mm^2/s$, viscosity index: 95) and 6 parts by mass of the vapor film-rupturing agents (A-b) to (T-b) were blended and agitated to prepare thermal treatment oil compositions.

The thermal treatment oil compositions thus prepared were measured for the characteristic number of seconds, the kinematic viscosity at 40° C., and the viscosity index according to the methods described above. The thermal treatment oil compositions were evaluated for the vapor film-rupturing effect based on the values of the characteristic number of seconds thus measured, according to the following standard. The results are shown in Table 1.

AA: The characteristic number of seconds was 1.00 seconds or less.

A: The characteristic number of seconds was more than 1.00 seconds and 1.50 seconds or less.

B: The characteristic number of seconds was more than 1.50 seconds and 2.00 seconds or less.

C: The characteristic number of seconds was more than 2.00 seconds.

As shown in Table 2, such results were obtained that the thermal treatment oil compositions containing any of the vapor film-rupturing agents (A-b) to (Q-b) prepared in Examples 1b to 17b had a characteristic number of seconds of 2.00 seconds or less and had a high vapor film-rupturing effect.

INDUSTRIAL APPLICABILITY

The vapor film-rupturing agent of the present invention is useful as an additive contained in a thermal treatment oil composition used in a thermal treatment, such as quenching, of a metal material.

The invention claimed is:

1. A thermal treatment oil composition, comprising:

a vapor film-rupturing agent comprising an asphaltene component, an aromatic component, a resin component, and a saturated hydrocarbon component; and a base oil, wherein the vapor film-rupturing agent is derived from asphalt as a starting material, the vapor film-rupturing agent comprising a fraction (x) (% by mass) of the saturated hydrocarbon component and a fraction (y) (% by mass) of the asphaltene component based on the total fraction 100% by mass of the saturated hydrocarbon component, the asphaltene component, the aromatic component, and the resin component, wherein fractions (x) and (y) are obtained by any one of analysis methods described in the Japan Petroleum Institute Standard and Manuals Testing Method for Petroleum Products JPI-5S-70-10 and the British Standard Test Method IP-469 that satisfies one or more of the following conditions (1) to (3):

| | Vapor film-rupturing agent | | | | | | | | | Evaluation of thermal treatment oil composition | | | |
|---|---|---|---|---|---|---|---|---|---|---|---|---|---|
| | | Fractions of four components | | | | | | | | | | | |
| | Kind | Fraction (x) of saturated component % by mass | Fraction (y) of asphaltene component % by mass | Fraction (z) of aromatic component % by mass | Fraction (w) of resin component % by mass | Total % by mass | (y)/(x) *1 — | Remaining coal % by mass | Characteristic number of seconds second | Evaluation of vapor film-rupturing effect — | Kinematic viscosity at 40° C. $mm^2/s$ | Viscosity index — |
| Example 1b | (A-b) | 14.5 | 9.6 | 62.6 | 13.3 | 100.0 | 0.66 | 18.2 | 1.90 | B | 17.58 | 104 |
| Example 2b | (B-b) | 14.0 | 9.7 | 59.8 | 16.5 | 100.0 | 0.69 | 16.3 | 1.83 | B | 17.27 | 103 |
| Example 3b | (C-b) | 14.1 | 10.3 | 58.0 | 17.6 | 100.0 | 0.73 | 17.2 | 1.71 | B | 17.24 | 103 |
| Example 4b | (D-b) | 13.4 | 10.3 | 60.4 | 15.9 | 100.0 | 0.77 | 17.7 | 1.91 | B | 17.31 | 103 |
| Example 5b | (E-b) | 14.3 | 10.5 | 55.8 | 19.4 | 100.0 | 0.73 | 17.0 | 1.65 | B | 17.30 | 103 |
| Example 6b | (F-b) | 13.7 | 11.0 | 57.7 | 17.6 | 100.0 | 0.80 | 17.0 | 1.60 | B | 17.23 | 103 |
| Example 7b | (G-b) | 2.6 | 14.2 | 58.4 | 24.8 | 100.0 | 5.46 | 26.9 | 1.13 | A | 17.98 | 103 |
| Example 8b | (H-b) | 2.3 | 14.7 | 58.7 | 24.3 | 100.0 | 6.39 | 28.7 | 1.01 | A | 17.98 | 103 |
| Example 9b | (I-b) | 2.5 | 14.8 | 59.4 | 23.3 | 100.0 | 5.92 | 28.3 | 1.03 | A | 17.91 | 104 |
| Example 10b | (J-b) | 2.7 | 14.8 | 57.3 | 25.2 | 100.0 | 5.48 | 27.9 | 0.98 | AA | 17.94 | 104 |
| Example 11b | (K-b) | 2.6 | 15.6 | 59.8 | 22.0 | 100.0 | 6.00 | 28.2 | 1.01 | A | 17.91 | 104 |
| Example 12b | (L-b) | 2.6 | 16.2 | 57.3 | 23.9 | 100.0 | 6.23 | 26.9 | 1.00 | AA | 18.06 | 104 |
| Example 13b | (M-b) | 0.0 | 16.5 | 31.9 | 51.6 | 100.0 | — | 33.2 | 1.43 | A | 18.99 | 113 |
| Example 14b | (N-b) | 12.3 | 11.9 | 56.3 | 19.5 | 100.0 | 0.97 | 17.6 | 1.43 | A | 17.42 | 103 |
| Example 15b | (0-b) | 5.8 | 19.6 | 51.3 | 23.3 | 100.0 | 3.38 | 27.0 | 0.68 | AA | 17.38 | 105 |
| Example 16b | (P-b) | 24.5 | 21.6 | 32.9 | 21.0 | 100.0 | 0.88 | 19.3 | 1.06 | A | 18.28 | 105 |
| Example 17b | (Q-b) | 0.8 | 4.2 | 73.5 | 21.5 | 100.0 | 5.25 | 17.3 | 1.95 | B | 18.63 | 111 |
| Comparative Example 1b | (R-b) | 57.0 | 0.4 | 36.4 | 6.2 | 100.0 | 0.01 | 0.4 | 2.89 | C | 17.89 | 112 |
| Comparative Example 2b | (S-b) | 24.1 | 2.3 | 56.1 | 17.5 | 100.0 | 0.10 | 6.9 | 2.86 | C | 17.90 | 101 |
| Reference Example 3b | (T-b) | 29.8 | 5.2 | 41.6 | 23.4 | 100.0 | 0.17 | 9.7 | 2.25 | C | 17.86 | 120 |

*1 a ratio of fraction (y) of asphaltene component/fraction (x) of saturated component condition (1): a value T calculated from the following calculation expression (1) is 2.4000 or less, wherein x (% by mass) represents the fraction (x) of the saturated hydrocarbon component, and y (% by mass) represents the fraction (y) of the asphaltene component:

$$T=1.2926\times x/100-8.113\times y/100+2.3384;\quad \text{Calculation expression (I):}$$

condition (2): the fraction (y) of the asphaltene component is 7.0% by mass or more; and condition (3): a ratio ((y)/(x)) of the fraction (y) of the asphaltene component and the fraction (x) of the saturated hydrocarbon component is 0.5 or more.

2. The thermal treatment oil composition according to claim 1, further comprising one or more additives for a thermal treatment oil selected from the group consisting of an antioxidant, a detergent, a dispersant, a glitter enhancing agent, and a thermal decomposition retarder.

3. The thermal treatment oil composition according to claim 2, wherein a total content of the one or more additives is up to 20% by mass, based on the total amount of the thermal treatment oil composition.

4. The thermal treatment oil composition according to claim 1, wherein the base oil has a kinematic viscosity at 40° C. of from 5 to 600 $mm^2/s$.

5. The thermal treatment oil composition according to claim 1, comprising from 0.1 to 20% by mass of the vapor film-rupturing agent based on the total amount of the thermal treatment oil composition.

6. The thermal treatment oil composition according to claim 1, which has a characteristic number of seconds in the cooling capability test according to JIS K2242 (2012) of 2.50 seconds or less.

7. The thermal treatment oil composition according to claim 1, wherein conditions (2) and (3) are satisfied.

8. The thermal treatment oil composition according to claim 1, wherein conditions (1), (2), and (3) are satisfied.

9. The thermal treatment oil composition according to claim 1, wherein condition (1) is satisfied.

10. The thermal treatment oil composition according to claim 9, wherein the fraction (y) of the asphaltene component is 3.0% by mass or more.

11. The thermal treatment oil composition according to claim 1, wherein the fraction (x) of the saturated hydrocarbon component is from greater than 0 to 40.0% by mass.

12. The thermal treatment oil composition according to claim 1, wherein the vapor film-rupturing agent has a content of remaining coal of from 8.0 to 40.0% by mass based on the total amount of the vapor film-rupturing agent.

13. The thermal treatment oil composition according to claim 1, wherein condition (2) is satisfied.

14. The thermal treatment oil composition according to claim 1, wherein condition (3) is satisfied.

15. The thermal treatment oil composition according to claim 1, wherein the composition does not contain a polymer as the vapor film rupturing agent.

16. The thermal treatment oil composition according to claim 1, wherein the fraction (y) of the asphaltene component is 9.0% by mass or more.

17. The thermal treatment oil composition according to claim 1, wherein the fraction (y) of the asphaltene component is 11.9% by mass or more.

18. The thermal treatment oil composition according to claim 1, wherein the fraction (x) of the saturated hydrocarbon component is from greater than 0 IQ 40.0% by mass, the fraction (y) of the asphaltene component is 3.0% by mass or more and 30.0% by mass or less, the fraction (z) of the aromatic component is from 20% to 90% by mass, and the fraction (w) of the resin component is from 5% to 60% by mass, based on the total fraction 100% by mass of the four components.

19. The thermal treatment oil composition according to claim 1, wherein the fraction (x) of the saturated hydrocarbon component is from greater than 0 to 24.5% by mass, the fraction (y) of the asphaltene component is 9.6% by mass or more and 21.6% by mass or less, the fraction (z) of the aromatic component is from 31.9% to 62.6% by mass, and the fraction (w) of the resin component is from 13.3% to 51.6% by mass, based on the total fraction 100% by mass of the four components.

* * * * *